US006116125A

United States Patent [19]

McLeod

[11] Patent Number: 6,116,125

[45] Date of Patent: Sep. 12, 2000

[54] GRIPPING ACCESSORY

[76] Inventor: Alistair McLeod, 11, Bella Street, Lakefield, Benoni, 1501 Gauteng Province, South Africa

[21] Appl. No.: 09/037,178

[22] Filed: Mar. 9, 1998

[51] Int. Cl.[7] ..... B25B 23/08

[52] U.S. Cl. ..... 81/456; 81/451

[58] Field of Search ..... 81/456, 458

[56] References Cited

U.S. PATENT DOCUMENTS

| | | | |
|---|---|---|---|
| 797,078 | 8/1905 | Shelton | 81/456 |
| 1,360,500 | 11/1920 | Coll | 81/458 |
| 2,317,085 | 4/1943 | Raby | 81/457 |
| 5,065,649 | 11/1991 | Evers et al. | 81/458 |

FOREIGN PATENT DOCUMENTS

| | | |
|---|---|---|
| 300474 | 11/1928 | United Kingdom . |
| 526935 | 9/1940 | United Kingdom . |
| 578230 | 6/1946 | United Kingdom . |
| 761736 | 11/1956 | United Kingdom . |
| 775613 | 5/1957 | United Kingdom . |
| 1008600 | 10/1965 | United Kingdom . |

*Primary Examiner*—David A. Scherbel
*Assistant Examiner*—Daniel Shanley
*Attorney, Agent, or Firm*—Hamilton, Brook, Smith & Reynolds, P.C.

[57] ABSTRACT

A gripping accessory comprises a body having first and second ends. The first end of the body is connectable to the shaft of a screwdriver at its tip, while the second end of the body is sized to received the head of a screw and has a gripping formation to hold the screw head in place. The portion of the body connected to the shaft of the screwdriver is a spiral.

11 Claims, 1 Drawing Sheet

GRIPPING ACCESSORY

FIELD OF THE INVENTION

This invention relates to a gripping accessory and, more particularly but not exclusively, to a screwdriver accessory for use in retaining a screw in position at the end of a screwdriver.

BACKGROUND OF THE INVENTION

In this specification, the term "screwdriver" is taken to incorporate a posi-drive screwdriver, an alien key driver, a phillips screwdriver, a cross-point screwdriver, a flat head screwdriver, a star point screwdriver and a socket head screwdriver, which can be manually operated or which can be driven by a power tool or the like.

In order to urge a screw into a surface, the screw must be held in an operative position, usually by hand, whilst a screwdriver is held in the other hand and engaged with the screw head and the screw is axially rotated until it catches sufficiently in the surface, whereupon the hand used to hold the screw can be removed. This is often disadvantageous as the screw may be too small to grip effectively, or the work area may be cramped making it difficult or impossible to hold the screw whilst screwing it in, and the need for using two hands often precludes a user from using his hands to steady himself or hold other items.

To alleviate these problems, magnetised screwdriver tips are known. Magnetised screwdriver tips have the disadvantage in that they can sometimes be insufficiently magnetised and a screw will fall off the end of the screwdriver before being fastened in place. The screw may also magnetically attach itself to the shaft of the screwdriver instead of the end of the screwdriver tip, requiring that the screw be re-positioned correctly at the end of the head. The magnetised screwdriver head may also magnetise the screw itself, which may be disadvantageous in certain circumstances.

Putty has also been employed to retain screws on the tip of a screwdriver. The putty becomes dirty, dries out and becomes ineffective. The putty can also fall off the screwdriver, which can be problematic if it falls into sensitive equipment.

OBJECT OF THE INVENTION

It is an object of this invention to provide a gripping accessory for retaining a screw on the tip of a screwdriver which will, at least partially, alleviate some of the above-mentioned disadvantages.

SUMMARY OF THE INVENTION

In accordance with this invention there is provided a gripping accessory having a body with first and second ends, the first end of the body being connectable to the shaft of a screwdriver proximate an operative tip of the screwdriver, the second end of the body being adapted to receive a head of a screw and having a gripping formation for retaining said screw head.

Further features of the invention provide for the body to be elongate, for the elongate body to be tubular, for a portion of the elongate tubular body closest to the first end thereof to be a spiral, and for the spiral to be wrappable, in use, around the shaft of the screwdriver.

Still further features of the invention provide for the body to be flared towards it second end, for the gripping formation to be an inwardly directed circumferential lip, alternatively a plurality of inwardly radially extending flexible fingers, and for there to be three radially extending flexible fingers equally spaced on the periphery of the elongate tubular body.

Preferably, the elongate tubular body has a circular cross-section, the elongate tubular body is made from one or more of the group of substances including a plastics materials, an elastomeric material or a resiliently deformable metal.

The invention extends to a screwdriver fitted with a gripping accessory as above described.

BRIEF DESCRIPTION OF THE DRAWINGS

A preferred embodiment of the invention will be described below by way of example only and with reference to the accompanying drawings, in which.

DETAILED DESCRIPTION OF THE INVENTION

Figure 1:
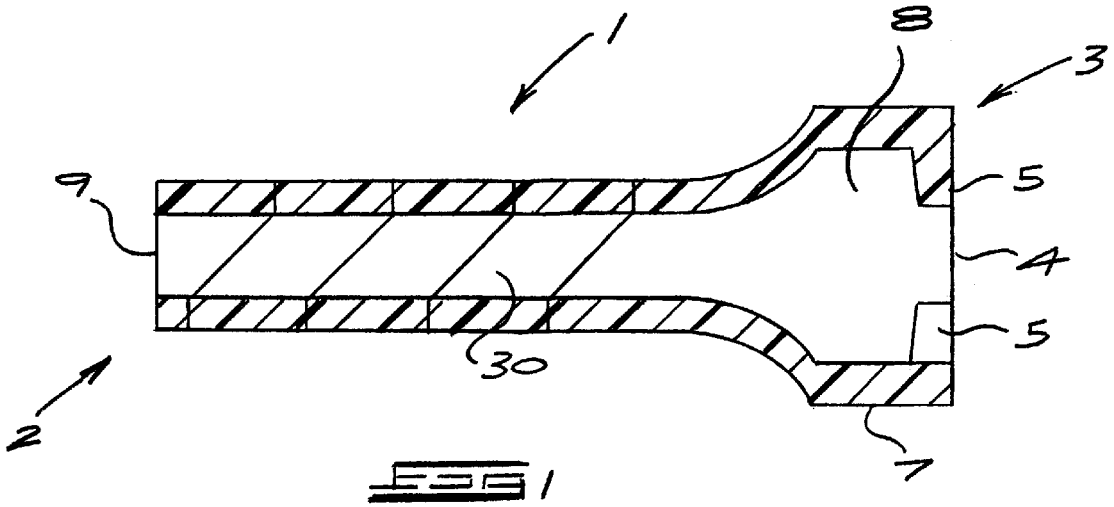
FIG. 1 is a sectional view of a first embodiment of a gripping accessory according to the invention.
Figure 2:
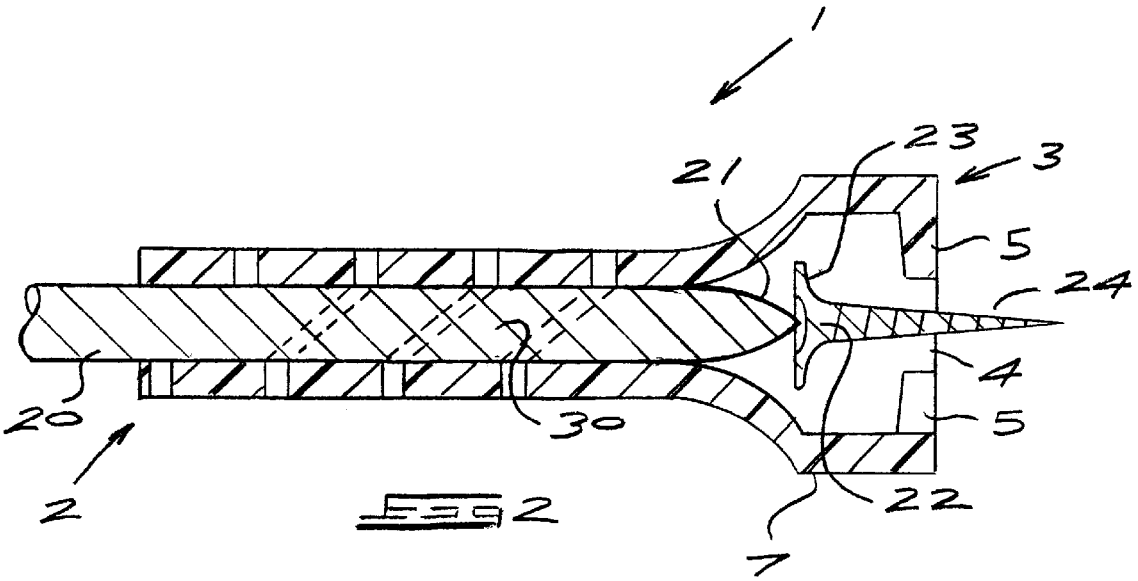
FIG. 2 is a sectional view of the gripping accessory of FIG. 1 shown in conjunction with a screwdriver and a screw.

Referring to the accompanying drawings in which like features of the invention are indicated by like numerals, a gripping accessory is indicated generally by reference numeral (1).

The gripping accessory (1) is made of a tube of resiliently deformable plastics material, generally cylindrical, having a first end and a second end. The first end (2) has a cylindrical opening (9) for receiving the shaft and the operative tip of a screwdriver (not shown). The second end (3) has an opening (4) and has a gripping formation in the form of three inwardly radially extending flexible fingers (5) evenly spaced around the circumference of the second end (3) of the accessory (1). The tube is outwardly flared towards it second end (3) forming an enlarged chamber (8) in the interior of the tube for receiving a screw (31) therein. A portion (30) of the tube closest to the first end (2) thereof is in the form of a resiliently deformable spiral.

In use, the gripping accessory is used as follows: the shaft (20) of the screwdriver having a star-point tip (21) is inserted into the cylindrical opening (9) at the first end (2) of the tube and pushed towards the second end (3) of the accessory (1). The head (23) of a screw (22) is pressed into the chamber (8) through the opening (4) by forcing it past the three inwardly radially extending flexible fingers (5) with its screw-threaded portion (24) protruding out of the second end (3) of the accessory (1). The screwdriver shaft (20) and tip (21) are then inserted further towards the second end (3) of the accessory (1) until the tip (21) contacts the head (23) of the screw (22).

The gripping accessory (1) is held securely on the shaft (20) of the screwdriver by the resiliently deformable spiral. The inwardly radially extending flexible fingers (5) prevent the screw (22) from falling out of the second end (3) of the accessory (1).

The screw-threaded portion (24) of the screw (23) is aligned with a surface (not shown) to be fastened and the screw is driven into the surface by the screwdriver without the necessity for the screw or the accessory to be held by the user. When the screw (23) has been driven into the material, the accessory (1) and screwdriver are pulled away from the secured screw (22), whereupon the inwardly radially extending flexible fingers (5) are forced apart by the head (23) of the screw which becomes dislodged from the chamber (8). The shaft (20) and tip (21) of the screwdriver can then be removed from the gripping accessory (1) by holding the accessory and pulling the shaft (20) out of the spiral (30).

It will be appreciated that numerous variations can be made to this embodiment without departing from the scope of the invention. In particular, the accessory (1) can be made in any number of shapes, including without the flare (7) at the bottom end, the chamber (8) may be of different sizes to accommodate different screw sizes, the flexible fingers (5) may be replaced by a lip extending into the opening from the periphery of the second end of the accessory.

The invention therefore provides an inexpensive and effective accessory to facilitate the insertion and removal of screws in awkward locations.

What I claim as new and desire to secure by Letters Patent is:

1. A gripping accessory having a molded resilient body with first and second ends, a portion of the molded resilient body closest to the first end thereof being a spiral connectable to the shaft of a screwdriver proximate an operative tip of the screwdriver, the second end of the molded resilient body being adapted to receive a head of a screw and having a gripping formation for retaining said screw head.

2. A gripping accessory as claimed in claim 1 in which the molded resilient body is elongate.

3. A gripping accessory as claimed in claim 1 in which the molded resilient body is tubular.

4. A gripping accessory as claimed in claim 3 in which a portion of the molded resilient body closest to the first end thereof is a spiral.

5. A gripping accessory as claimed in claim 1 in which the spiral is wrappable, in use, around the shaft of the screwdriver.

6. A gripping accessory as claimed in claim 1 in which the molded resilient body is flared towards its second end.

7. A gripping accessory as claimed in claim 1 in which the gripping formation in an inwardly directed circumferential lip.

8. A gripping accessory as claimed in claim 1 in which the gripping formation is a plurality of inwardly radially extending flexible fingers.

9. A gripping accessory as claimed in claim 8 in which there are three radially extending flexible fingers equally spaced on the periphery of the molded resilient body.

10. A gripping accessory as claimed in claim 1 in which the molded resilient body has a circular cross-section.

11. A gripping accessory as claimed in claim 1 in which the molded resilient body is made from one or more of the group of substances including a plastics material, an elastomeric material or a resiliently deformable metal.

* * * * *